US007981593B2

(12) United States Patent
Katoh et al.

(10) Patent No.: US 7,981,593 B2
(45) Date of Patent: Jul. 19, 2011

(54) TONER, DEVELOPER INCLUDING THE TONER, AND IMAGE FORMING METHOD AND APPARATUS USING THE TONER

(75) Inventors: Hiroaki Katoh, Nagaokakyo (JP); Hideaki Yasunaga, Ibaraki (JP); Kazuoki Fuwa, Toyonaka (JP); Yoshihiro Mikuriya, Nishinomiya (JP); Masayuki Hagi, Minoo (JP); Masahide Inoue, Numazu (JP)

(73) Assignee: Ricoh Company Limited, Tokyo (JP)

( * ) Notice: Subject to any disclaimer, the term of this patent is extended or adjusted under 35 U.S.C. 154(b) by 514 days.

(21) Appl. No.: 11/855,759

(22) Filed: Sep. 14, 2007

(65) Prior Publication Data

US 2008/0069608 A1 Mar. 20, 2008

(30) Foreign Application Priority Data

Sep. 15, 2006 (JP) ..... 2006-251186
Aug. 6, 2007 (JP) ..... 2007-204312

(51) Int. Cl.
*G03G 15/20* (2006.01)

(52) U.S. Cl. ..... 430/320; 430/322

(58) Field of Classification Search ..... 399/320, 399/322

See application file for complete search history.

(56) References Cited

U.S. PATENT DOCUMENTS 6,430,381 B1 * 8/2002 Kopp ..... 399/69
6,635,398 B1 * 10/2003 Komoto et al. ..... 430/108.23
6,924,073 B2 * 8/2005 Higuchi et al. ..... 430/108.4
7,169,525 B2 * 1/2007 Sugiura et al. ..... 430/108.4
7,524,600 B2 * 4/2009 Toizumi et al. ..... 430/108.3
2003/0082472 A1 * 5/2003 Kondo et al. ..... 430/108.3
2003/0165759 A1 * 9/2003 Suzuki et al. ..... 430/108.4
2005/0074608 A1 * 4/2005 Sawada et al. ..... 428/388
2005/0277046 A1 * 12/2005 Sawada et al. ..... 430/109.4
2006/0040194 A1 * 2/2006 Sugiura et al. ..... 430/108.4
2006/0204882 A1 9/2006 Nozaki et al.
2006/0210902 A1 9/2006 Nakamura et al.
2006/0275686 A1 12/2006 Kadota et al.
2006/0292474 A1 12/2006 Mikuriya et al.

(Continued)

FOREIGN PATENT DOCUMENTS

JP 2004-69941 3/2004
JP 2005-189520 7/2005

OTHER PUBLICATIONS

U.S. Appl. No. 12/241,656, filed Sep. 30, 2008, Yasunaga, et al.

(Continued)

*Primary Examiner* — Hoa V Le
(74) *Attorney, Agent, or Firm* — Oblon, Spivak, McClelland, Maier & Neustadt, L.L.P.

(57) ABSTRACT

A toner including toner particles including a resin, a colorant, a wax, and a charge controlling agent, and an external additive, wherein the toner satisfies the relationships (1) $0.15\times Q-2 \leqq T \leqq 0.15\times Q-0.15$, and (2) $1.0 \leqq T \leqq 2.5$, wherein Q represents the charge of the toner in units of μC/g, and T represents the torque of the toner in units of mN·m determined by a method using a cone-shaped rotor while controlling a space ratio of the toner at 58%. A developer including the toner and a carrier. An image forming apparatus including an image bearing member, a transfer device, a fixing device and a double side image forming unit, and using the toner, wherein the receiving material includes moisture in an amount of not greater than 5% by weight after the toner image on the first side is fixed.

10 Claims, 3 Drawing Sheets

U.S. PATENT DOCUMENTS

| | | | |
|---|---|---|---|
| 2007/0026335 | A1 | 2/2007 | Yamamoto et al. |
| 2007/0059625 | A1 | 3/2007 | Yamamoto et al. |
| 2007/0122729 | A1 | 5/2007 | Katoh et al. |
| 2007/0148568 | A1 | 6/2007 | Kadota et al. |
| 2007/0190443 | A1 | 8/2007 | Hagi et al. |
| 2007/0207399 | A1 | 9/2007 | Kadota et al. |

OTHER PUBLICATIONS

U.S. Appl. No. 12/197,651, filed Aug. 25, 2008, Katoh, et al.

U.S. Appl. No. 11/624,525, filed Jan. 18, 2007, Hideaki Yasunaga, et al.

* cited by examiner

TONER, DEVELOPER INCLUDING THE TONER, AND IMAGE FORMING METHOD AND APPARATUS USING THE TONER

BACKGROUND OF THE INVENTION

1. Field of the Invention

The present invention relates to a toner for developing an electrostatic image. In addition, the present invention also relates to a developer including the toner, and an image forming method and an image forming apparatus using the toner.

2. Discussion of the Background

Recently, a need exists for a low end laser beam printer which is low-cost and compact and which can perform high speed printing. In order to miniaturize a laser beam printer, a technique in that an intermediate transfer medium is supported by two rollers instead of three rollers is proposed. In this case, discharging tends to occur in a gap between the intermediate transfer medium and a sheet of an image receiving material to which a toner image is to be transferred from the intermediate transfer medium. In addition, it is necessary to shorten the passage through which an image receiving material sheet is fed so that a toner image is transferred and fixed thereon. When a double sided copy is produced in such an image forming apparatus, the time period of from heat fixation of an image on a first side of an image receiving material sheet to transfer of another image on a second side of the receiving material is very short. In this case, the electric resistivity of the receiving material sheet increases in the heat fixation process, and thereby a problem in that the second image cannot be well transferred onto the second side is caused.

Further, in order to miniaturize an image forming apparatus while reducing the costs thereof, it is necessary for the image forming apparatus to use a two-roller fixing device without an oil applicator. The toner used for such an image forming apparatus needs to include a release agent. However, the adhesiveness of the toner to image forming members such as photoreceptors and intermediate transfer media increases, thereby causing problems such that a toner image cannot be well transferred (i.e., defective image transfer) and/or a transferred toner image has an omission therein.

In attempting to solve the defective image transfer problem caused by change of the electric resistance of an image receiving material sheet, published unexamined Japanese patent application No. (hereinafter referred to as JP-A) 2004-069941 discloses a technique in that after being previously heated, an image receiving material sheet receives toner images on both sides thereof while being subjected to one-pass feeding. The purpose of this technique is to prevent occurrence of the defective image transfer problem caused by change of moisture in a receiving material sheet.

In addition, in attempting to solve the defective image transfer problem caused by change of the thickness of image receiving material sheets, JP-A 2005-189520 discloses an image forming method including the steps of obtaining information on the properties of the receiving material; and controlling the image transfer conditions on the basis of the properties of the receiving material.

Because of these reasons, a need exists for a toner (or an image forming method and apparatus), which can produce high quality images on both sides of image receiving materials.

SUMMARY OF THE INVENTION

As one aspect of the present invention, a toner is provided which includes toner particles including at least a resin, a colorant, a wax and a charge controlling agent, and an external additive, wherein the toner satisfies the following relationships (1) and (2):

$$0.15\times Q-2\leqq T\leqq 0.15\times Q-0.15 \quad (1), \text{ and}$$

$$1.0\leqq T\leqq 2.5 \quad (2),$$

wherein Q represents the quantity of charge of the toner in units of μC/g, and T represents the torque of the toner in units of mN·m determined by a method using a grooved cone-shaped rotor while controlling the space ratio of the toner at 58%. The quantity of charge is measured with a suction method using a suction-type Q/m analyzer Model 210HS-2A from Trek Inc. It is preferable that the quantity of charge of the toner constituting an image formed on an intermediate transfer medium of an image forming apparatus, IPSIO CX3000.

As another aspect of the present invention, a developer (a non-magnetic two-component developer) is provided which includes the toner mentioned above and a carrier. The toner mentioned above can also be used as a non-magnetic one-component developer.

As yet another aspect of the present invention, an image forming apparatus is provided which includes an image bearing member configured to bear a toner image thereon; a transfer device configured to transfer the toner image on the image bearing member to a first side of an image receiving material via an intermediate transfer medium; a fixing device configured to fix the toner image onto the receiving material; and a double side image forming unit configured to feed the receiving material to the transfer device so that a second toner image is transferred onto the second side of the receiving material, followed by fixation of the second toner image by the fixing device, wherein the first and second toner images are formed of the toner mentioned above. The toner in the toner images on the intermediate transfer medium satisfies the relationships (1) and (2). It is preferable that the receiving material includes moisture in an amount of not greater than 5% by weight after the first fixing process (at a time within 180 seconds after the first fixing process).

As a further aspect of the present invention, an image forming method is provided which includes transferring a first toner image on an image bearing member to a first side of an image receiving material via an intermediate transfer medium; fixing the first toner image on the image receiving material; transferring a second toner image on the image bearing member to the second side of the receiving material via the intermediate transfer medium; and fixing the second toner image on the second side of the receiving material, wherein the toner images are formed of the toner mentioned above. The toner in the first and second toner images on the intermediate transfer medium satisfies the relationships (1) and (2). It is preferable that the receiving material includes moisture in an amount of not greater than 5% by weight after the first-mentioned fixing process.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

At first, the image forming apparatus of the present invention will be explained by reference to drawings.

Figure 1:
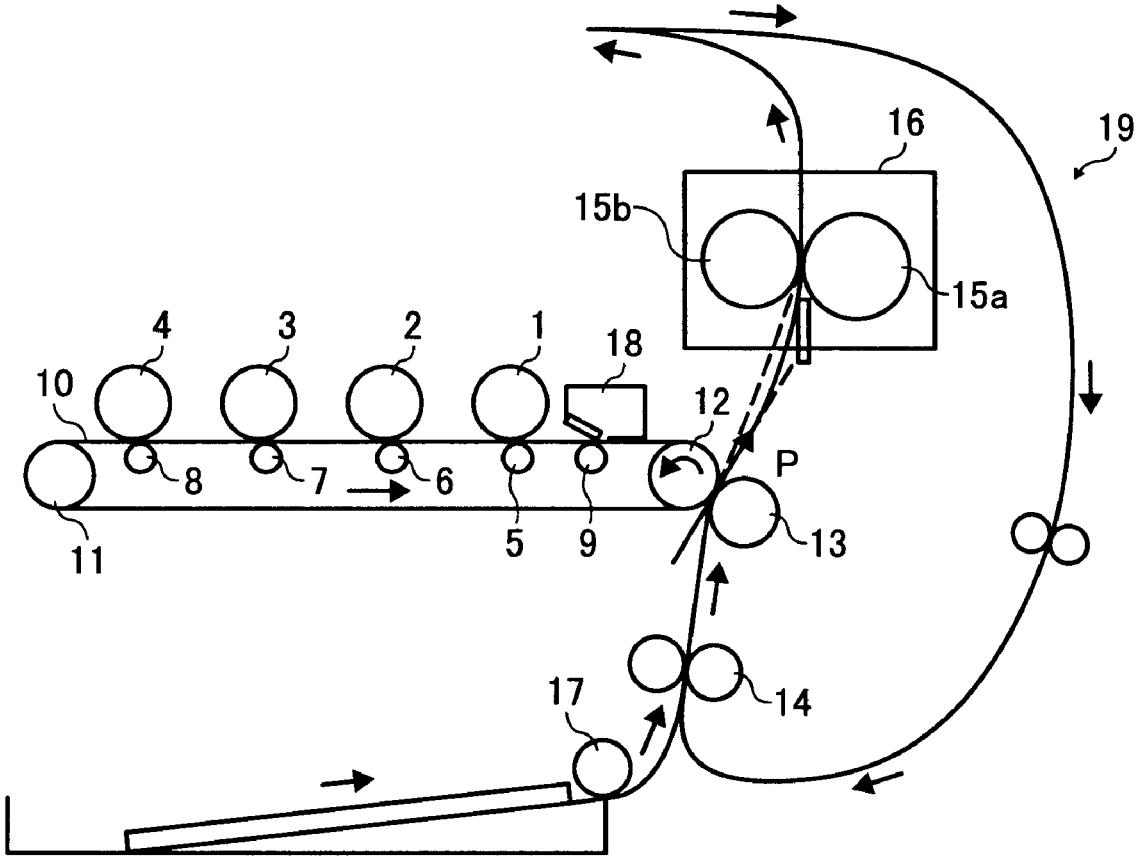
FIG. 1 is a schematic view illustrating an example of the image forming apparatus of the present invention, which can perform double-sided image formation.

FIG. 1 is a schematic view illustrating an example of the image forming apparatus of the present invention, which can perform double-sided image formation. Referring to FIG. 1, four photoreceptors 1, 2, 3 and 4 bear thereon different color images (such as yellow, magenta, cyan and black images) constituted of respective color toners. The image forming apparatus includes an image forming unit including the photoreceptors 1-4 forms different color toner images on the photoreceptors 1-4; and a transfer device including an intermediate transfer belt 10, which serves as an intermediate transfer medium and which is rotated while tightly stretched by a belt driving roller 11 and a secondary transfer opposing roller 12, four primary transfer rollers 5, 6, 7 and 8, to each of which a predetermined voltage (i.e., a primary transfer bias) is applied, and a secondary transfer roller 13, to which a predetermined voltage (i.e., a secondary transfer bias) is applied. The color toner images on the photoreceptors 1-4 are transferred onto the intermediate transfer belt 10 so as to be overlaid thereon.

The secondary transfer roller 13 presses a sheet of a receiving material P, which has been fed from a tray by a feeding roller 17 and a pair of registration rollers 14, toward the secondary transfer opposing roller 12 to form a secondary transfer nip while applying the secondary transfer bias thereto. Therefore, the color toner images are transferred to the receiving material sheet P at the secondary transfer nip. The receiving material sheet P bearing the color toner images thereon is fed to a fixing device 16. Fixing rollers 15*a* and 15*b* of the fixing device 16 apply heat and pressure to the receiving material sheet P to fix the color toner images thereon. When single-sided image formation is performed, the receiving material sheet bearing a fixed toner image thereon is discharged from the image forming apparatus. A cleaner 18 removes and collects toner particles remaining on the surface of the intermediate transfer belt 10 without being transferred to the receiving material sheet P. Numeral 9 denotes a backup roller of the cleaner 18.

When double-sided image formation is performed, the receiving material sheet P fed from the fixing device 16 is switched back through a passage 19 to be fed again to the secondary transfer nip, at which a second toner image is transferred, and the fixing device by which the second toner image is fixed thereon.

The fixing device 16 is preferably an oil-less two-roller fixing device.

The toner of the present invention, which is used for the image forming apparatus, includes toner particles including at least a resin, a colorant, a wax and a charge controlling agent, and an external additive, wherein the toner satisfies the following relationships (1) and (2):

$$0.15\times Q-2\leqq T\leqq 0.15\times Q-0.15 \quad (1), \text{ and}$$

$$1.0\leqq T\leqq 2.5 \quad (2),$$

wherein Q represents the quantity of charge of the toner in units of μC/g, and T represents the torque of the toner in units of mN·m determined by a method using a grooved cone-shaped rotor while controlling the space ratio of the toner at 58%.

When these conditions are satisfied, occurrence of a problem in that a second image formed on the second side of a double-sided copy is microscopically uneven (hereinafter sometimes referred to as "granular") can be prevented and therefore high quality images can be produced.

Figure 2:
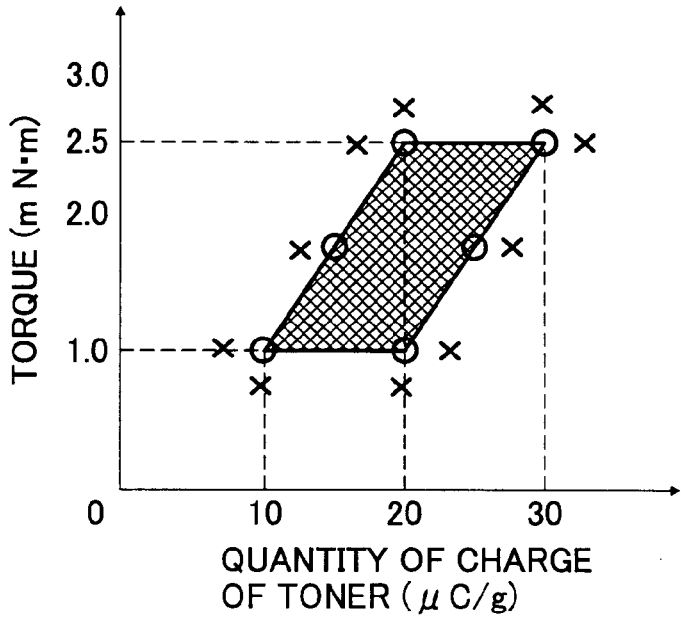
FIG. 2 is a graph illustrating the relationship between the quality (granularity of image) of toner images and the properties of the toner (charge quantity and torque)

FIG. 2 is a graph illustrating the relationship between the granularity of toner images and the properties (charge quantity and torque) of the toner. In FIG. 2, the above-mentioned conditions are satisfied in the shaded portion, and therefore high quality images can be produced. In other words, under the conditions other than the shaded portions, granular images are produced and therefore high quality images cannot be produced.

The torque of the toner largely changes depending on the form of the toner particles, the amount of wax present on the surface portion of the toner particles, conditions of the external additive (such as whether the external additive is well adhered to the toner particles and whether the external additive produces a spacer effect), etc. The present inventors discover that it is preferable for toners to satisfy the relationships (1) and (2) to produce high quality double-sided copies.

Specifically, as the degree of deformation of the toner particles increases, the torque of the toner increases. When the amount of wax present on the surface portion of the toner particles increases, the torque of the toner increases. When the external additive is too strongly adhered to the toner particles, the torque of the toner increases because the external additive tends to be embedded into the toner particles. When the particle diameter of the external additive is large (for example, a silica having a particle diameter of from 70 to 500 nm is used), the external additive can produce a spacer effect, and thereby the torque of the toner is decreased.

The toner of the present invention preferably has a volume average particle diameter of from 5 to 12 μm, and more preferably from 6 to 10 μm, which is determined by an instrument MULTISIZER III from Beckmann Coulter Inc. from the viewpoint of image qualities.

The toner of the present invention preferably includes a release agent in the toner particles thereof so that a receiving material sheet bearing a toner image thereon can be well released from the fixing members.

The toner of the present invention includes toner particles preferably including at least a first binder resin including a hydrocarbon wax therein, a second binder resin, a colorant and a charge controlling agent, and an external additive.

The toner of the present invention is a non-magnetic one component developer or is used for a non-magnetic two component developer, which includes a carrier in addition to the toner.

The receiving material preferably has a moisture content of not greater than 5% by weight at a time within 180 seconds after the first fixing process in which the first image formed on the first side of the receiving material sheet is fixed by the fixing device. In addition, the volume resistivity of the receiving material sheet is preferably from $10^9$ to $10^{11}$ Ω·cm before the first fixing process, and is preferably from $10^{11}$ to $10^{13}$ Ω·cm after the first fixing process (at a time within 180 seconds after the first fixing process). The resistivity is measured under an environmental condition of 24° C. and 50% RH using a digital super high resistance/minute electric current meter R8340A from ADC Corporation.

The binder resin of the toner of the present invention will be explained.

The first and second binder resins of the toner of the present invention are not particularly limited. Specific examples of the resins for use as the binder resin include resins for use in conventional full color toners such as polyester resins, (meth) acrylic resins, styrene-(meth)acrylic copolymers, epoxy resins, cyclic olefin copolymers (COC) (e.g., TOPAS-COC from Ticona), etc. Among these resins, polyester resins are preferably used for the first and second binder resins because the resultant toner can be preferably used for oil-less fixing devices.

Suitable polyester resins for use as the binder resin include polyester resins prepared by subjecting a polyhydric alcohol and a polybasic carboxylic acid to a polycondensation reaction.

Suitable polyhydric alcohol components include diols and polyols. Specific examples of diols include alkylene oxide adducts of bisphenol A such as polyoxypropylene(2.2)-2,2-bis(4-hydroxyphenyl)propane, polyoxypropylene(3.3)-2,2-bis(4-hydroxyphenyl)propane, polyoxypropylene(6)-2,2-bis(4-hydroxyphenyl)propane, and polyoxyethylene(2.0)-2,2-bis(4-hydroxyphenyl)propane; ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropyleneglycol, polyethylene glycol, polytetramethylene glycol, bisphenol A, hydrogenated bisphenol A, etc.

Specific examples of the polyols having three or more hydroxyl groups include sorbitol, 1,2,3,6-hexanetetrol, 1,4-sorbitane, pentaerythritol, dipentaerythritol, tripentaerythritol, 1,2,4-butanetriol, 1,2,5-pentanetriol, glycerol, 2-methylpropanetriol, 2-metyl-1,2,4-butanetriol, trimethylol ethane, trimethylol propane, 1,3,5-trihydroxymethyl benzene, etc.

Polybasic carboxylic acids include dibasic carboxylic acids and polybasic carboxylic acids having three or more carboxyl groups.

Specific examples of the dibasic carboxylic acids include maleic acid, fumaric acid, citraconic acid, itaconic acid, glutaconic acid, phthalic acid, isophthalic acid, terephthalic acid, cyclohexanedicarboxylic acid, succinic acid, adipic acid, sebacic acid, azelaic acid, malonic acid, n-dodecenylsuccinic acid, isododecenylsuccinic acid, n-dodecylsuccinic acid, isododecylsuccinic acid, n-octenylsuccinic acid, isooctenylsuccinic acid, n-octylsuccinic acid, isooctylsuccinic acid, anhydrides and lower alkyl esters of these acids, etc.

Specific examples of the polybasic carboxylic acids having three of more carboxyl groups include 1,2,4-benzenetricarboxylic acid (i.e., trimellitic acid), 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, trimers of embole, anhydrides and lower alkyl esters of these acids, etc.

In addition, vinyl polyester resins which are prepared by subjecting a mixture including monomers for preparing a polyester resin, one or more vinyl monomers for preparing a vinyl resin and one or more reactive monomers capable of reacting the monomers for the polyester resin and vinyl resin to a polycondensation reaction and a radical polymerization reaction in a reaction vessel can also be used as the binder resin. The reactive monomers are monomers which can be used for both a polycondensation reaction and a radical polymerization reaction. Specifically, the reactive monomers are monomers having both a carboxyl group and a vinyl group therein. Specific examples thereof include fumaric acid, maleic acid, acrylic acid, methacrylic acid, etc.

Specific examples of the monomers for use in preparing polyester resins include the polyhydric alcohols and polybasic carboxylic acids mentioned above.

Specific examples of the monomers for use in preparing vinyl resins include styrene and styrene derivatives such as styrene, o-methylstyrene, m-methylstyrene, p-methylstyrene, α-methylstyrene, p-ethylstyrene, 2,4-dimethylstyrene, p-tert-butylstyrene, and p-chlorostyrene; ethylene-type unsaturated monoolefins such as ethylene, propylene, butylene and isobutylene; alkyl esters of methacrylic acid such as methyl methacrylate, n-propyl methacrylate, isopropyl methacrylate, n-butyl methacrylate, isobutyl methacrylate, tert-butyl methacrylate, n-pentyl methacrylate, isopentyl methacrylate, neopentyl methacrylate, 3-methylbutyl methacrylate, hexyl methacrylate, octyl methacrylate, nonyl methacrylate, decyl methacrylate, undecyl methacrylate, and dodecyl methacrylate; alkyl esters of acrylic acid such as methyl acrylate, n-propyl acrylate, isopropyl acrylate, n-butyl acrylate, isobutyl acrylate, tert-butyl acrylate, n-pentyl acrylate, isopentyl acrylate, neopentyl acrylate, 3-methylbutyl acrylate, hexyl acrylate, octyl acrylate, nonyl acrylate, decyl acrylate, undecyl acrylate, and dodecyl acrylate; unsaturated carboxylic acids such as acrylic acid, methacrylic acid, itaconic acid, and maleic acid; acrylonitrile, esters of maleic acid, esters of itaconic acid, vinyl chloride, vinyl acetate, vinyl benzoate, vinyl methyl ketone, vinyl hexyl ketone, vinyl methyl ether, vinyl ethyl ether, vinyl isobutyl ether, etc.

Specific examples of the radical polymerization initiator include azo- or diazo-type initiators such as 2,2'-azobis(2,4-dimethylvaleronitrile), 2,2'-azobisisobutylonitrile, 1,1'-azobis(cyclohexane-1-carbonitrile), and 2,2'-azobis-4-methoxy-2,4-dimethylvaleronitrile; peroxide-type initiators such as benzoyl peroxide, dicumyl peroxide, methyl ethyl ketone peroxide, isopropylperoxy carbonate, and lauroyl peroxide; etc.

The toner of the present invention preferably includes a first binder resin selected from polyester resins prepared by subjecting a polyhydric alcohol and a polybasic carboxylic acid to a polycondensation reaction and a second binder resin selected from vinyl polyester resins. In this case, the toner has a good combination of releasability from fixing members and offset resistance. More preferably, the first binder resin is selected from polyester resins obtained from an alkylene oxide adduct of bisphenol A (serving as a polyhydric alcohol) and terephthalic acid and/or fumaric acid (serving as a polybasic carboxylic acid). In addition, the second binder resin is more preferably selected from vinyl polyester resins obtained from monomers for polyester resins such as alkylene oxide adducts of bisphenol A, terephthalic acid, trimellitic acid and succinic acid, monomers for vinyl resins such as styrene and butyl acrylate, and a reactive monomer such as fumaric acid.

It is preferable that a hydrocarbon wax is included in a first binder resin when the first binder resin is synthesized. Specifically, it is preferable that when a first binder resin is synthesized, a mixture of monomers for the first binder resin (e.g., an acid monomer and an alcohol monomer for preparing a polyester resin) and a hydrocarbon wax is subjected to a polymerization reaction (e.g., a polycondensation reaction). When a vinyl polyester resin is used as the first binder resin, it is preferable that a mixture of monomers for a polyester resin and a hydrocarbon wax is agitated upon application of heat thereto to perform a polycondensation reaction while dropping vinyl resin monomers thereto to perform a radical polymerization reaction.

Suitable waxes for use in the toner of the present invention include hydrocarbon waxes with a low polarity. In this case, the resultant toner has good releasability from fixing members such as fixing rollers. The content of the wax in the toner is preferably from 3 to 10 parts by weight per 100 parts by weight of the toner.

Among hydrocarbon waxes, waxes which are constituted of carbon atoms and hydrogen atoms and which do not include a group such as ester groups, alcoholic groups, and amide groups are preferably used. Specific examples thereof include petroleum waxes such as polyolefin waxes (e.g., polyethylene, polypropylene, and ethylene-propylene copolymers), paraffin waxes and microcrystalline waxes; synthesized waxes such as Fischer Tropsch waxes; etc. Among these waxes, polyethylene waxes, paraffin waxes and Fischer Tropsch waxes are preferably used, and polyethylene waxes and paraffin waxes are more preferably used.

The toner can include a wax dispersing agent configured to well disperse a wax in the toner. The wax dispersing agent is not particularly limited, and known wax dispersing agents can be used. Suitable examples of such wax dispersing agents include block polymers or oligomers which include a unit having a good solubility to waxes and another unit having a good solubility to resins, and graft polymers or oligomers which include a unit having a good solubility to waxes and another unit having a good solubility to resins, wherein one of the units is grafted. Specific examples of such polymers and oligomers include copolymers of one or more unsaturated hydrocarbons such as ethylene, propylene, butane, styrene and α-methyl styrene with one or more α, β-unsaturated carboxylic acids (and esters and anhydrides thereof) such as acrylic acid, methacrylic acid, maleic anhydride, itaconic acid, and itaconic anhydride; block and graft copolymers of one or more vinyl resins and one or more polyester resins; etc.

Specific examples of the units having a good solubility to waxes include alkyl groups having not less than 12 carbon atoms, polyethylene units, polypropylene units, polybutene units, polybutadiene units, and combinations of the groups and units. Specific examples of the units having a good solubility to resins include polyester units, vinyl resin units, etc.

The toner of the present invention can include a charge controlling agent.

Specific examples of the charge controlling agents include Nigrosine dyes, triphenyl methane dyes, chromium-containing metal complex dyes, molybdic acid chelate pigments, Rhodamine dyes, alkoxyamines, quaternary ammonium salts, fluorine-modified quaternary ammonium salts, alkylamides, phosphor and its compounds, tungsten and its compounds, fluorine-containing activators, metal salts of salicylic acid, metal salts of salicylic acid derivatives, etc. These materials can be used alone or in combination.

Specific examples of the marketed charge controlling agents include BONTRON 03 (Nigrosine dye), BONTRON P-51 (quaternary ammonium salt), BONTRON S-34 (metal-containing azo dye), BONTRON E-82 (metal complex of oxynaphthoic acid), BONTRON E-84 (metal complex of salicylic acid), and BONTRON E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE PSY VP2038 (quaternary ammonium salt), COPY BLUE (triphenyl methane derivative), COPY CHARGE NEG VP2036 and COPY CHARGE NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments, and polymers having a functional group such as a sulfonate group, a carboxyl group, a quaternary ammonium group, etc. Among these charge controlling agents, charge controlling agents capable of imparting a negative charge to the toner can be preferably used.

The content of the charge controlling agent in the toner of the present invention is determined depending on the variables such as choice of binder resin, presence of additives, and dispersion method. In general, the added amount of the charge controlling agent is preferably from 0.1 to 10 parts by weight, and more preferably from 0.2 to 5 parts by weight, per 100 parts by weight of the binder resin included in the toner. When the added amount is too large, the charge quantity of the toner excessively increases, and thereby the electrostatic attraction between the developing roller and the toner increases, resulting in deterioration of fluidity and decrease of image density. When the added amount is too small, the effects of the charge controlling agent are hardly produced.

The toner for use in the image forming apparatus of the present invention includes a colorant. Suitable materials for use as the colorant include known dyes and pigments.

Specific examples of the dyes and pigments include carbon black, Nigrosine dyes, black iron oxide, NAPHTHOL YELLOWS, HANSA YELLOW 10G, HANSA YELLOW 5G, HANSA YELLOW G, Cadmium Yellow, yellow iron oxide, loess, chrome yellow, Titan Yellow, polyazo yellow, Oil Yellow, HANSA YELLOW GR, HANSA YELLOW A, HANSA YELLOW RN, HANSA YELLOW R, PIGMENT YELLOW L, BENZIDINE YELLOW G, BENZIDINE YELLOW GR, PERMANENT YELLOW NCG, VULCAN FAST YELLOW 5G, VULCAN FAST YELLOW R, Tartrazine Lake, Quinoline Yellow LAKE, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED F2R, PERMANENT RED F4R, PERMANENT RED FRL, PERMANENT RED FRLL, PERMANENT RED F4RH, Fast Scarlet VD, VULCAN FAST RUBINE B, Brilliant Scarlet G, LITHOL RUBINE GX, Permanent Red F5R, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE RS, INDANTHRENE BLUE BC, Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials are used alone or in combination.

The content of the colorant in the toner is preferably from 1 to 15% by weight, and more preferably from 3 to 10% by weight of the toner.

Master batches, which are complexes of a colorant with a resin, can be used as the colorant of the toner for use in the present invention.

Specific examples of the resins for use as the binder resin of the master batches include the polyester resins and vinyl resins mentioned above for use in the binder resin. In addition, rosin, modified rosins, terpene resins, aliphatic or alicyclic hydrocarbon resins, aromatic petroleum resins, chlorinated paraffin, paraffin waxes, etc. can also be used. These can be used alone or in combination.

Such master batches can be prepared by mixing one or more of the resins as mentioned above and one or more of the colorants as mentioned above and kneading the mixture while applying a high shearing force thereto. In this case, an organic solvent can be added to increase the interaction between the colorant and the resin. In addition, a flushing method in which an aqueous paste including a colorant and water is mixed with a resin dissolved in an organic solvent and kneaded so that the colorant is transferred to the resin side (i.e., the oil phase), and then the organic solvent (and water, if desired) is removed can be preferably used. When performing the mixing and kneading process, dispersing devices capable of applying a high shearing force such as three roll mills can be preferably used.

The toner of the present invention can include an external additive to improve the fluidity, developability, chargeability and durability of the toner. Suitable examples of the external additive include particulate inorganic materials, which preferably have a specific surface area (determined by a BET absorption method) of from 30 to 300 $m^2/g$, an average primary particle diameter of from 10 to 50 nm and an adhesion strength of from 30 to 80%.

The primary particle diameter of an external additive is determined as follows.

(1) particles of an external additive are observed with a transmission electron microscope (TEM) to measure the primary particle diameters of randomly selected 200 particles;

(2) the 200 data are averaged to determine the volume average primary particle diameter of the external additive.

In this regard, the magnification of the TEM is 500,000 power for particles having primary particle diameter of from 5 to 50 nm, and 50,000 power for particles having primary particle diameter of greater than 50 nm and not greater than 500 nm.

The adhesion strength is determined as follows.

(1) two grams of a toner is pressed for 60 seconds at a pressure of 1 $N/cm^2$ to prepare a pellet of the toner, and the pellet is subjected to an analysis using a fluorescent X-ray analyzer (wavelength disperse fluorescent X-ray analyzer XRF1700 from Shimadzu Corp.) to determine the amount (Wb) of the external additive adhered to the toner particles by checking the amount of an element specific to the external additive (for example, silicon when a silica is used as an external additive) using a working curve;

(2) two grams of the toner is mixed with 30 g of a 10% by weight aqueous solution of a surfactant;

(3) the mixture is agitated for 1 minute by a homogenizer while applying a power of 40 W to the homogenizer;

(4) the toner is separated from the surfactant solution, followed by washing and drying; and (5) the thus treated toner is also palletized and analyzed using the fluorescent X-ray analyzer to determine the amount (Wa) of the external additive adhered to the toner particles after the treatment.

The adhesive strength (A) is represented by the following equation;

$$A=(Wa/Wb)\times 100(\%).$$

Specific examples of such external additives include inorganic materials such as silica, zinc oxide, tin oxide, sand-lime, titanium oxide, clay, mica, wollastonite, diatom earth, chromium oxide, cerium oxide, red iron oxide, antimony trioxide, magnesium oxide, aluminum oxide, zirconium oxide, barium sulfate, barium carbonate, calcium carbonate, silicon carbide, and silicon nitride.

When the average primary particle diameter of the external additive is too small, the external additive tends to be embedded into the toner particles, and thereby image qualities deteriorate, resulting in shortening of the life of the toner. In contrast, when the average primary particle diameter of the external additive is too large, the external additive tends to easily release from the toner particles and thereby a film of the toner particles is formed on an image bearing member such as photoreceptors, resulting in deterioration of image qualities.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

Preparation of First Binder Resin

The following components were contained in a dropping funnel.

Vinyl Monomers

| | |
|---|---|
| Styrene | 600 g |
| Butyl acrylate | 110 g |
| Acrylic acid | 30 g |
| Dicumylperoxide (polymerization initiator) | 30 g |

The following components were contained in a four necked 5-liter flask equipped with a thermometer, a stainless stirrer, a condenser, and a nitrogen feed pipe.

Monomers for Polyester Resin

| | |
|---|---|
| Polyoxypropylene(2.2)-2,2-bis(4-hydroxylphenyl)propane | 1230 g |
| Polyoxyethylene(2.2)-2,2-bis(4-hydroxylphenyl)propane | 290 g |
| Isododecenyl succinic anhydride | 250 g |
| Terephthalic acid | 310 g |
| 1,2,4-benzenetricarboxylic acid anhydride | 180 g |
| Dibutyl tin oxide (esterification catalyst) | 7 g |
| Paraffin wax | 135 g |

(melting point: 73.3° C., half width of absorption peak in DSC: 4° C., weight ratio of monomers to wax: 100:4.5)

The components in the four-necked flask were heated to 160° C. by a mantle heater under a nitrogen gas flow while agitated with the stirrer. In addition, the components in the dropping funnel was dropped in the flask over one hour. After the mixture was heated for 2 hours at 160° C. to complete an addition polymerization reaction, there action product was heated to 230° C. to perform a polycondensation reaction. The polymerization degree of the reaction product was occasionally checked using a constant-pressure orifice rheometer. When the reaction product had a desired softening point, the polycondensation reaction was stopped. Thus, a first resin H having a softening point of 130° C. was prepared.

Preparation of Second Binder Resin

The following components were contained in a four necked 5-liter flask equipped with a thermometer, a stainless stirrer, a condenser, and a nitrogen feed pipe.

Monomers for Polyester Resin

| | |
|---|---|
| Polyoxypropylene(2.2)-2,2-bis(4-hydroxylphenyl)propane | 2210 g |
| Terephthalic acid | 850 g |
| 1,2,4-benzenetricarboxylic anhydride | 120 g |
| Dibutyl tin oxide (esterification catalyst) | 0.5 g |

The components in the four-necked flask were heated to 230° C. by a mantle heater under a nitrogen gas flow while agitated with the stirrer to perform a polycondensation reaction. The polymerization degree of the reaction product was occasionally checked using a constant-pressure orifice rheometer. When the reaction product had a desired softening point, the polycondensation reaction was stopped. Thus, a second binder resin L having a softening point of 115° C. was prepared.

Preparation of Toner

The following components were mixed with a HENSCHEL MIXER mixer.

| | |
|---|---|
| First binder resin | 70 parts |
| Second binder resin | 30 parts |
| C.I. Pigment Red 57-1 | 4 parts |

(which is included in a pigment master batch in a pigment/resin ratio of 0.5)

The mixture was then melted and kneaded with a double-axis kneader PCM-30 from Ikegai Corp, from which a discharging portion had been removed. The kneaded mixture was then cooled by a cooling press roller so as to have a thickness of 2 mm, followed by cooling with a cooling belt. After the cooled mixture was crushed with a feather mill, the resultant particles were pulverized with a mechanical pulverizer KTM from Kawasaki Heavy Industries, Ltd. so as to have an average particle diameter of from 10 to 12 μm, followed by pulverization with a jet pulverizer IDS from Nippon Pneumatic Mfg. Co., Ltd. while being subjected to a coarse particle classification. The particle diameters of the particles produced by the pulverization operations using KTM and IDS are shown in Table 1 below. The pulverized mixture was then subjected to a fine particle classification using a rotor classifier TURBOPLEX 100 ATP from Hosokawa Micron Corp. Thus, a colored particulate resin 1 (CPR1) having the desired volume average particle diameter (8.5 μm) and circularity (0.910) was prepared. The properties of the colored particulate resin 1 (i.e., volume average particle diameter (Dv), and wax content are described in Table 1 below.

The following components were mixed using a HENSCHEL MIXER mixer.

| | |
|---|---|
| Colored particulate resin 1 | 100 parts |
| Fumed silica serving as external additive (CAB-O-SIL TS530 from Cabot Corp.) | 1.5 parts |
| Titanium oxide serving as external additive (STT-30A from Titan Kogyo K.K.) | 0.5 parts |

Thus, a magenta toner of Example 1 was prepared. The added amount of the external additive is described in Table 1 below.

Examples 2-6 and Comparative Examples 1-10

The procedure for preparation of the toner of Example 1 was repeated except that the formulation of the toner and preparation conditions therefor were changed as described in Tables 1 and 2.

The thus prepared toners were evaluated as follows.

(1) Fluidity of Toner

In the present application, the fluidity of a toner is evaluated by a method using a cone-shaped rotor.

Figure 3:
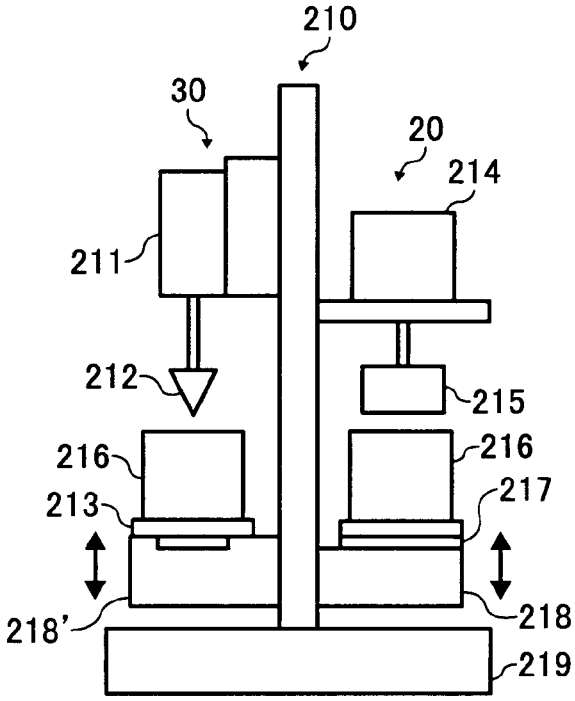
FIG. 3 is a schematic view illustrating an example of the instrument for evaluating the torque of a toner.

FIG. 3 is a schematic view illustrating an example of the instrument for evaluating the fluidity of a toner. In FIG. 3, an instrument 210 includes a pressing zone 20 and a measuring zone 30.

The pressing zone 20 includes a container 216 for containing a powder (toner), a lifting stage 218 for lifting the container up and down, a piston 215 for pressing the powder, and a weight 214 for applying a load to the piston 215.

The container 216 containing a powder therein is lifted up so as to be contacted with the piston 215. The container 216 is further lifted up so that all the weight of the weight 214 is applied to the piston 215 (i.e., the weight 214 floats over a support plate 219). The container 216 is then allowed to settle for a predetermined time. Then the lifting stage 218 is lifted down so that the piston 215 is released from the surface of the powder.

The material constituting the piston 215 is not particularly limited, but the surface thereof, which is contacted with the powder, is preferably smooth. Therefore, the piston 215 is preferably made of a material having a surface which is hard and is hardly degenerated. In addition, it is preferable that a charged powder is not adhered to the surface of the piston 215, and therefore the piston 215 is preferably made of an electroconductive material. Specific examples of such materials include metals such as stainless steels (e.g., SUS), Al, Cu, Au, Ag and brass.

In the instrument used for measuring the toners prepared above, the container 216 has an inside diameter of 60 mm and the height of the pressed powder (i.e., toner) is from 25 to 28 mm.

Referring to FIG. 3, the measuring zone 30 includes the container 216 containing the pressed powder therein, a second lifting stage 218' for lifting the container 216 up and down, a load cell 213 for measuring the load applied to the powder, and a torque meter 211 for measuring the torque of the powder. The structure of the instrument is not limited thereto.

A cone-shaped rotor 212 is fixed with the tip of the shaft of the torque meter 211 so as not to move up and down. The container 216 containing the pressed powder is set on the center of the second lifting stage 218'. Then the second lifting stage 218' is lifted up so that the cone-shaped rotor 212 enters into the center of the pressed powder while rotating. The torque of the cone-shaped rotor 212 is measured with the torque meter 211 while the load applied to the container 216 is measured with the load cell 213. In addition, the moving distance of the cone-shaped rotor is measured with a position sensor (not shown). Numeral 217 denotes a load cell.

The structure of the measuring zone 30 is not limited thereto, and the measuring zone 30 can have a structure such that the shaft of the torque meter 211 is lifted up and down to lift the rotor 212 up and down.

Figure 4:
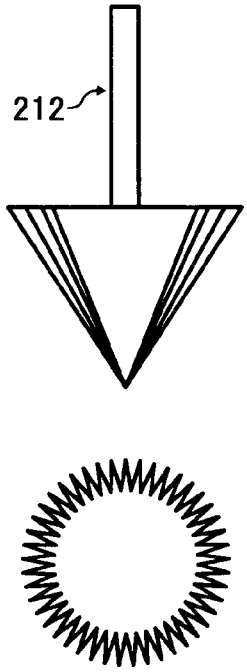
FIG. 4 is a schematic view illustrating the cone-shaped rotor of the instrument illustrated in FIG. 4.

FIG. 4 is a schematic view illustrating the con-shaped rotor 212. As illustrated in FIG. 4, the surface of the rotor 212 has grooves. In addition, the top of the rotor 212 has an angle of 60°. The grooves are straight grooves extending from the top of the cone to the bottom thereof. The grooves have a triangle form and are arranged like teeth of a saw. The bottom of the cone has a diameter of 30 mm, and the length of the side slope of the cone is 30 mm. The depth of the grooves is 0 mm at the top of the cone, and is 1 mm at the bottom of the cone. The depth gradually increases toward the bottom of the cone. The cone has 48 grooves. This rotor is hereinafter referred to as a cone-shaped rotor I.

In this instrument, the friction between the surface of the cone-shaped rotor 212 and toner particles is not measured and the friction between the toner particles is measured. Specifically, among the grooved side slopes of the cone, only the tops of the grooves are friction-contacted with the toner particles, and at the other portions of the side slopes the toner particles located in the recessed portions of the grooves (which toner particles are fixed) are friction-contacted with the toner particles in the vicinity thereof.

The cone-shaped rotor 212 is preferably made of a material having a surface which is hard and is hardly degenerated. In addition, it is preferable that a charged toner is not adhered to the surface of the rotor 212, and therefore the rotor 212 is preferably made of an electroconductive material. Specific examples of such materials include metals such as stainless steels (e.g., SUS), Al, Cu, Au, Ag and brass.

The fluidity of a toner is measured by measuring the torque or load when the cone-shaped rotor 212 is moving in the pressed toner while rotated. Specifically, the second lifting stage 218' is lifted up and down so that the cone-shaped rotor 212 is entered into or pulled from the pressed toner while rotated. In this case, the torque applied to the rotor or load applied to the container 216 is measured to determine the fluidity of the toner. The torque and load changes depending on the rotation speed (i.e., revolution per minute (rpm)) of the rotor 212, and the moving speed (i.e., entering speed) of the rotor 212 in the vertical direction. The rotation speed and the moving speed are preferably from 0.1 to 100 rpm and 0.5 to 150 mm/min, respectively. However, in order to improve the precision in determination of the fluidity (i.e., in order to precisely measure the fluidity of toner particles in a delicate contact state), the rotation speed and moving speed of the rotor 212 are preferably as low as possible. Therefore, in this application, the measurement conditions are as follows.

Rotation speed of rotor: 1.0 rpm

Moving speed of rotor: 1.0 mm/min

Toner pressing conditions: 0.1 kg/cm$^2$ (pressure)

Not less than 60 sec (time)

Rotor used: Cone-shaped rotor I

When the entering distance of the rotor, by which the rotor 212 is entered into the pressed toner, is too short, the torque or load detected is small, and therefore data with high reproducibility cannot be obtained. Therefore, it is preferable that the entering distance is considerably long to obtain data with high reproducibility. As a result of the present inventors' experiments, it is found that the entering distance is preferably not less than 5 mm.

In addition, the space ratio of the toner layer is important. The space ratio ($\epsilon$) of the toner layer is defined by the following equation:

$$\epsilon=(V-M/\rho)/V$$

wherein V represents the volume of the toner layer in the container, M represents the weight of the toner layer, and $\rho$ represents the true specific gravity of the toner.

In general, a toner is constituted of toner particles and an external additive such as silica and titanium oxide. Therefore, it is preferable to control not only the properties of toner particles but also the properties of the toner (i.e., the mixture of the toner particles and an external additive) in order to control the cleanability of the toner. In general, an external additive (such as silica and titanium oxide) is added to toner particles to improve the fluidity of the toner particles. Improvement in fluidity of a toner means reduction in friction coefficient between toner particles of the toner. A toner having a better fluidity causes a lower friction torque to the cone-shaped rotor 212.

In general, with respect to the space ratio of toner, the more the better. As a result of the present inventors' experiments, it is found that a toner having a space ratio of not less than 50% has a good cleanability. When a toner having a lower space ratio is adhered to the tip of a cleaning blade, the toner presses the cleaning blade at a higher pressure, and thereby particles of the toner remaining on the image bearing member can more easily pass through the gap between the blade and the surface of the image bearing member. However, when the space ratio is greater than 60%, the toner tends to scatter, and thereby a problem in that the image forming apparatus is contaminated with the toner is caused.

As a result of the present inventors' investigation, it is found that a toner having properties such that the toner collected in a toner collection device has a space ratio of from 50 to 60%, and a torque of from 1.0 to 2.5 mN·m when the rotor enters the toner layer by a distance of 20 mm has good cleanability. The reason why a toner having such properties has a good cleanability is considered to be as follows. When a toner having a torque in the range is cleaned with a blade, particles of the toner transported to the cleaning blade while borne on the surface of an image bearing member can be easily released from the surface by other particles of the toner staying in the vicinity of the blade, and thereby the particles of the toner can be well removed from the surface of the image bearing member. When the torque is too low, the toner tends to scatter, and thereby a problem in that the image forming apparatus is contaminated with the toner is caused. In contrast, when the torque is too large, the toner has a large cohesive force, and thereby the cleanability of the toner is deteriorated, resulting in formation of an abnormal image including a ghost image of a previously formed image.

Figure 5:
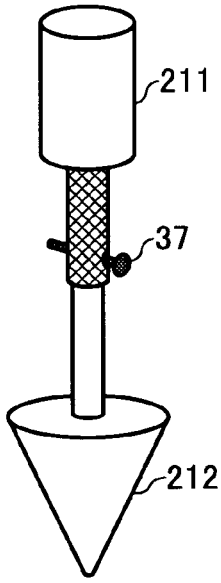
FIG. 5 is a schematic view illustrating the cone-shaped rotor attached to the instrument.

FIG. 5 is a schematic view for explaining the way to connect the cone-shaped rotor to the torque meter. As illustrated in FIG. 5, the cone-shaped rotor 212 is connected with the shaft of the torque meter 211 using a spanner screw 37. Therefore, various rotors (such as rotors made of different materials) can be attached to the torque meter and detached therefrom. Therefore, the fluidities of a toner against different materials can be easily measured.

The torque meter 211 is preferably a non-contact high sensitivity torque meter. In addition, the load cell 213 is preferably a load cell having a wide load range and high definition. Linear scales and optical displacement sensors, which have a precision of not greater than 0.1 mm, can be used for the position detector. The lifting device for lifting the stages 218 and 218' is preferably a device which can precisely lift the stage up and down using a servo motor or a stepping motor.

(2) Charge Quantity (Q/m)

A solid image having a vertical length of 10 mm and a horizontal length of 100 mm is formed on a transfer belt of an image forming apparatus (modified version of IPSIO CX3000 from Ricoh Co., Ltd. (only the thickness of the photoreceptor drum is changed)). After the image forming apparatus is suddenly stopped, and the charge quantity (i.e., charge-to-mass ratio Q/m) of the particles of the toner constituting the solid toner image is determined by a suction-type Q/m analyzer Model 210/HS-2A from Trek Inc.

(3) Moisture in Receiving Material (Paper)

The moisture in the receiving paper bearing a fixed toner image on one side thereof is measured with a moisture meter MX-5000 from Kett Electric Laboratory.

(4) Transferability of Toner (Evenness (Granularity of Image)

After each toner is set to the image forming apparatus (modified version of IPSIO CX3000 from Ricoh Co., Ltd.), a solid image is formed on both sides of a receiving paper. The solid images are visually observed to evaluate the evenness (granularity) of the images (particularly, the images formed on the backside). The transferability of toners is graded as follows.

○: Usable (i.e., the solid images are on a usable level).

X: Unusable (i.e., the solid images are on an unusable level because of being uneven).

The results are shown in Tables 1 and 2.

TABLE 1

| Colored particulate resin (CPR) | Particle diameter of particles in pulverization processes (μm) KTM* | Dv (μm) IDS*2 | Content of wax*3 (parts by weight) | Content of wax*4 (parts by weight) | Properties of colored particulate resin | Space ratio (%) | Torque (mN · m) |
|---|---|---|---|---|---|---|---|
| CPR1 | 10.2 | 7.2 | 8.1 | 4.5 | 3 | 58 | 1.0 |
| CPR2 | 10.2 | 5.5 | 6.4 | 12.9 | 8 | 58 | 2.5 |
| CPR3 | 10.2 | 7.2 | 8.1 | 7.7 | 5 | 58 | 1.8 |
| CPR4 | 10.2 | 5.5 | 6.4 | 4.5 | 3 | 58 | 2.7 |
| CPR5 | 12.3 | 9.6 | 10.2 | 14.8 | 9 | 58 | 0.8 |

KTM*: mechanical pulverizer

IDS*2: jet pulverizer

Content of wax*3: the added amount (parts by weight) of the wax based on 100 parts by weight of the monomer for the first binder resin.

Content of wax*4: the content (parts by weight) of the wax based on 100 parts by weight of the colored particulate resin.

TABLE 2

| | Colored particulate resin (CPR) | Added amount of TS530 (parts by weight) | Added amount of STT30A (parts by weight) | Torque (mN · m) | Q/m (μC/g) | Evenness (granularity) of solid images |
|---|---|---|---|---|---|---|
| Ex. 1 | CPR1 | 1.5 | 0.5 | 1.00 | 10 | ○ |
| Ex. 2 | CPR1 | 1.5 | 0.2 | 1.00 | 20 | ○ |
| Ex. 3 | CPR2 | 1.5 | 0.2 | 2.50 | 20 | ○ |
| Ex. 4 | CPR2 | 1.5 | 0.1 | 2.50 | 30 | ○ |
| Ex. 5 | CPR3 | 1.5 | 0.3 | 1.75 | 15 | ○ |
| Ex. 6 | CPR3 | 1.5 | 0.1 | 1.75 | 25 | ○ |
| Comp. Ex. 1 | CPR1 | 1.5 | 1.0 | 1.00 | 5 | X |
| Comp. Ex. 2 | CPR1 | 1.5 | 0 | 1.00 | 25 | X |
| Comp. Ex. 3 | CPR2 | 1.5 | 0.4 | 2.50 | 15 | X |
| Comp. Ex. 4 | CPR2 | 1.5 | 0 | 2.50 | 35 | X |
| Comp. Ex. 5 | CPR3 | 1.5 | 0.5 | 1.75 | 10 | X |
| Comp. Ex. 6 | CPR3 | 1.5 | 0 | 1.75 | 30 | X |
| Comp. Ex. 7 | CPR4 | 1.5 | 0.5 | 0.80 | 10 | X |
| Comp. Ex. 8 | CPR4 | 1.5 | 0.3 | 0.80 | 20 | X |
| Comp. Ex. 9 | CPR5 | 1.5 | 0.1 | 2.70 | 20 | X |
| Comp. Ex. 10 | CPR5 | 1.5 | 0 | 2.70 | 30 | X |

It is clear from Tables 1 and 2 that the toners of Examples 1 to 6, which satisfy the relationships (1) and (2) mentioned above, can produce even solid images even on the second side (backside) of a receiving material but the toners of Comparative Examples 1 to 10, which do not satisfy the relationships, produce uneven images on the second side of the receiving material.

This document claims priority and contains subject matter related to Japanese Patent Applications Nos. 2006-251186 and 2007-204312, filed on Sep. 15, 2006, and Aug. 6, 2007, respectively, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An image forming method comprising:

transferring a first image of a toner on an image bearing member to a first side of a receiving material via an intermediate transfer medium;

fixing the first toner image on the first side of the receiving material via an intermediate transfer medium, wherein the receiving material includes moisture in an amount of not greater than 5% by weight after fixing the toner image on the first side of the receiving material;

transferring a second image of the toner on the image bearing member to a second side of the receiving material via the intermediate transfer medium; and fixing the second toner image on the second side of the receiving material, wherein the toner comprises a toner particle and an external additive, the toner particle comprises:

a first binder resin;

a hydrocarbon wax;

a second binder resin;

a colorant; and a charge controlling agent, the first binder resin is a vinyl polyester resin including the hydrocarbon wax therein, the second binder resin is a polyester resin, the external additive is a silica having a specific surface area of 30-300 $m^2/g$ and an adhesion strength of 30-80%, the toner has a volume average particle diameter of 5-12 μm, and the toner satisfies the following relationships (1) and (2):

$$0.15\times Q-2\leqq T\leqq 0.15\times Q-0.15 \quad (1), \text{ and}$$

$$1.0\leqq T\leqq 2.5 \quad (2),$$

Q represents a charge of the toner in units of μC/g, and T represents a torque of the toner in units of mN·m determined by a method using a grooved cone-shaped rotor while controlling a space ratio of the toner at 58%.

2. The image forming method according to claim 1, wherein the receiving material has a volume resistivity of from $10^9$ to $10^{11}$ Ω·cm before fixing the first toner image on the first side and a volume resistivity of from $10^{11}$ to $10^{13}$ Ω·cm after fixing the first toner image on the first side.

3. The image forming method according to claim 1, wherein the hydrocarbon wax is present in an amount of 3-10 parts by weight, based on 100 parts by weight of the toner.

4. The image forming method according to claim 1, wherein the colorant is present in an amount of 1-15 parts by weight, based on 100 parts by weight of the toner.

5. The image forming method according to claim 1, wherein the charge controlling agent is present in an amount of 0.1-10 parts by weight, based on 100 parts by weight of a combined amount of the first and second binder resin.

6. The image forming method according to claim 1, wherein the external additive is present in an amount of 0.5-2.0 parts by weight, based on 100 parts by weight of the toner particle.

7. The image forming method according to claim 1, wherein the external additive has an average primary particle diameter of 10-50 nm.

8. The image forming method according to claim 1, wherein the hydrocarbon wax and the external additive are present on a surface of the toner particle.

9. An image forming method comprising:

transferring a first image of a toner on an image bearing member to a first side of a receiving material via an intermediate transfer medium;

fixing the first toner image on the first side of the receiving material via an intermediate transfer medium, wherein the receiving material includes moisture in an amount of not greater than 5% by weight after fixing the toner image on the first side of the receiving material;

transferring a second image of the toner on the image bearing member to a second side of the receiving material via the intermediate transfer medium; and fixing the second toner image on the second side of the receiving material, wherein the toner comprises: a toner particle; and 0.5-2.0 parts by weight of an external additive, based on 100 parts by weight of the toner particle, the toner particle comprises:

a first binder resin;

3-10 parts by weight of a hydrocarbon wax, based on 100 parts by weight of the toner, wherein the hydrocarbon wax is present on a surface of the toner particle;

a second binder resin;

1-15 parts by weight of a colorant, based on 100 parts by weight of the toner; and 0.1-10 parts by weight of a charge controlling agent, based on 100 parts by weight of a combined amount of the first and second binder resin, the first binder resin is a vinyl polyester resin including the hydrocarbon wax therein, the second binder resin is a polyester resin, the external additive is present on the surface of the toner particle, and wherein the external additive is a silica having a specific surface area of 30-300 $m^2/g$, an average primary particle diameter of 10-50 nm, and an adhesion strength of 30-80%, the toner has a volume average particle diameter of 5-12 μm, and the toner satisfies the following relationships (1) and (2):

$$0.15\times Q-2\leqq T\leqq 0.15\times Q-0.15 \quad (1), \text{ and}$$

$$1.0\leqq T\leqq 2.5 \quad (2),$$

Q represents a charge of the toner in units of μC/g, and T represents a torque of the toner in units of mN·m determined by a method using a grooved cone-shaped rotor while controlling a space ratio of the toner at 58%.

10. The image forming method according to claim 9, wherein the receiving material has a volume resistivity of from $10^9$ to $10^{11}$ Ω·cm before fixing the first toner image on the first side and a volume resistivity of from $10^{11}$ to $10^{13}$ Ω·cm after fixing the first toner image on the first side.

* * * * *